US009629424B2

(12) United States Patent
Seely et al.

(10) Patent No.: US 9,629,424 B2
(45) Date of Patent: Apr. 25, 2017

(54) FLESH TUNNEL FINDING, DANGLE JEWELRY AND METHOD

(71) Applicants: Tristan A Seely, Lynnwood, WA (US); Edward G. Sencenbaugh, Lynnwood, WA (US)

(72) Inventors: Tristan A Seely, Lynnwood, WA (US); Edward G. Sencenbaugh, Lynnwood, WA (US)

( * ) Notice: Subject to any disclaimer, the term of this patent is extended or adjusted under 35 U.S.C. 154(b) by 9 days.

(21) Appl. No.: 14/602,906

(22) Filed: Jan. 22, 2015

(65) Prior Publication Data

US 2015/0201719 A1 Jul. 23, 2015

Related U.S. Application Data

(60) Provisional application No. 61/930,874, filed on Jan. 23, 2014.

(51) Int. Cl.
*A44C 7/00* (2006.01)
*A44C 15/00* (2006.01)
*A44C 25/00* (2006.01)

(52) U.S. Cl.
CPC ..... *A44C 7/002* (2013.01); *A44C 15/0035* (2013.01); *A44C 25/001* (2013.01)

(58) Field of Classification Search
CPC ... A44C 25/001; A44C 7/002; A44C 15/0035; A44C 7/00; A44C 25/00; A44C 15/00; G09F 3/12; G09F 3/14; G09F 3/16; G09F 3/08
USPC ..... 63/12–13, 23; 24/3.12, 598.2, 546, 40, 24/66.5–66.6, 708.8, 710.8–710.9; 40/667, 664
See application file for complete search history.

(56) References Cited

U.S. PATENT DOCUMENTS

| | | | | | |
|---|---|---|---|---|---|
| 70,584 | A | * | 11/1867 | Grushus | B21D 25/04 72/302 |
| 107,679 | A | | 9/1870 | Haberland | |
| 161,853 | A | | 4/1875 | Baker | |
| 1,684,783 | A | | 11/1925 | Spear | |
| 2,061,927 | A | * | 11/1936 | Weiss | G09F 3/14 40/664 |
| 3,739,599 | A | | 6/1973 | Melone | |
| 4,067,341 | A | | 1/1978 | Ivey | |
| 5,979,021 | A | * | 11/1999 | Swift | A41D 25/003 24/546 |
| 8,443,626 | B2 | | 5/2013 | Simpson et al. | |

* cited by examiner

*Primary Examiner* — Abigail Morrell
(74) *Attorney, Agent, or Firm* — Dean A Craine

(57) ABSTRACT

A finding used with dangle jewelry with a decorative jewel element configured to attach to a flesh tunnel or an orifice formed in an earlobe. The finding includes a single, thin rigid wire with two longitudinally aligned posts formed on opposite ends configured for insertion into the opposite ends of the flesh tunnel or orifice. The sections of the wire adjacent to the posts form earlobe extending sections that extend downward over the opposite surfaces of the earlobe. Formed below the earlobe extending sections is a compression ring with two side elements on opposite sides of the finding's longitudinal axis. Each side element is integral with the earlobe extending section located on the opposite side of the earlobe. When the two side elements are forced inward the two posts located are forced apart allowing the finding to be easily attached or detached from the flesh tunnel or orifice.

6 Claims, 6 Drawing Sheets

FLESH TUNNEL FINDING, DANGLE JEWELRY AND METHOD

This utility patent application is based on and claims the filing date benefit of U.S. provisional patent application (Application No. 61/930,874) filed on Jan. 23, 2014.

COPYRIGHT NOTICE

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention relates to body jewelry and more particularly to gauged body jewelry.

2. Description of the Related Art

Gauged jewelry is piercing jewelry that requires the insertion of body piercing jewelry into an enlarged orifice formed in a desired location on the body, such as an earlobe, eyebrow or nose septum. A small orifice is formed in the tissue that is gradually stretched and enlarged by tapered or expanding gauges. After the orifice with the desired diameter is formed, the orifice may be filled with a solid, decorative cylindrical plug or with a cylindrical flesh tunnel with an empty center bore. The center bore enables viewers to see through the earlobe creating a unique, captivating appearance.

Dangle jewelry is large, decorative jewelry that hangs vertically from a body orifice or from a flesh tunnel formed or embedded into an earlobe. A finding is inserted into the orifice or into the flesh tunnel's center bore used to hang a decorative jewelry element. When the upper end of the finding is inserted into the center bore, it can be easily dislodged. In some instances, the upper end of the finding is placed between the skin and the outside surface of the plug or flesh tunnel which can be uncomfortable and cause tissue irrigation and damage.

What is needed is an improved finding for dangle jewelry specifically configured to be easily and securely attached to a flesh tunnel and is attractive and, less prone to being snagged and dislodged.

SUMMARY OF THE INVENTION

Disclosed is a finding designed for attaching dangle jewelry to a flesh tunnel. The flesh tunnel is a rigid, cylindrical structure with a center bore and two opposite end openings. The finding comprises a single wire formed or configured into three interconnected sections—an upper flesh tunnel engaging section configured to selectively engage a flesh tunnel, an intermediate earlobe extension section configured to extend downward along front and rear surfaces of the earlobe when the flesh tunnel engaging section is engaged to a flesh tunnel, and a lower biasing section that extends under the earlobe and connects to a decorative jewelry element. The lower biasing section can be easily manipulated by the user to attach and detach the finding from the flesh tunnel. The three above sections are formed symmetrically around the finding's longitudinal axis.

The flesh tunnel engaging section includes two straight posts configured to extend inward through the flesh tunnel's opposite ends and rest inside the flesh tunnel's center bore. The posts are aligned substantially perpendicular to the finding's longitudinal axis and sufficiently rigid to retain their shape to vertically support the finding and a decorative jewelry element from the flesh tunnel. The lengths of the posts are sufficient to be supported by the flesh tunnel and also allow the posts to be forced apart a sufficient distance to allow them to be easily removed from the flesh tunnel.

The intermediate earlobe extension section is configured to extend downward along front and rear surfaces of the earlobe when the two posts are inserted into the flesh tunnel. In one embodiment, the earlobe extension section comprises two legs integral with and perpendicularly aligned with the two posts. The shape and lengths of the legs are sufficient so that the two legs extend slightly below the lower surface of the earlobe. The lower portion of each leg extends or curves inward and converges with the opposite leg near the finding's longitudinal axis and forms the lower biasing section.

The lower biasing section is a compression ring formed in the middle section of the wire. The compression ring includes two side elements on opposite sides of the finding's longitudinal axis when attached to the flesh tunnel. The compression ring is located under the earlobe and the side elements are integral with the legs on the opposite sides of the earlobe. In one embodiment, the compression ring is a circular or oval-shaped ring that includes a front arc integral with the leg located adjacent to the rear surface of the earlobe and a rear arc integral with the leg located adjacent to the front surface of the earlobe. The arcs are identical in diameter so that when inward force is applied to them, they compress inward the same distance.

In one embodiment, the lower portions of the two arcs cross and form a closed, lower loop centrally aligned with the finding's longitudinal axis. In another embodiment, the lower portions of the two arcs are joined to form a continuous ring structure. A decorative jewelry element is attached to the lower loop or directly to the continuous ring structure.

During use, the finding's two posts are inserted into the flesh tunnel's center bore. The upper portions of the legs press against the outside ends of the flesh tunnel thereby preventing excessive, side-to-side movement of the finding on the flesh tunnel that can cause irritation or discomfort.

The wire is sufficiently rigid and elastic so that the above sections formed in the wire maintained their original shapes and orientations during normal use. Because each side element is integral to a leg on the opposite side of the finding's longitudinal axis, and each leg is integral with the post on the same side of the longitudinal axis, when the two side elements on the compression ring are forced inward, the finding's two posts located inside the flesh tunnel are forced apart allowing them to be easily removed from the center bore. When the no force is applied to the side elements, the posts return to their original longitudinally aligned position. It should also be understood the wire is also sufficiently flexible to allow one end of the wire to be temporarily bent to allow a decorative jewelry element to be attached to the compression ring or to the small loop.

Using the above described finding, a piece of dangle jewelry and a method for attaching dangle jewelry to a flesh tunnel are also described.

DESCRIPTION OF THE PREFERRED EMBODIMENT(S)

Figure 1:
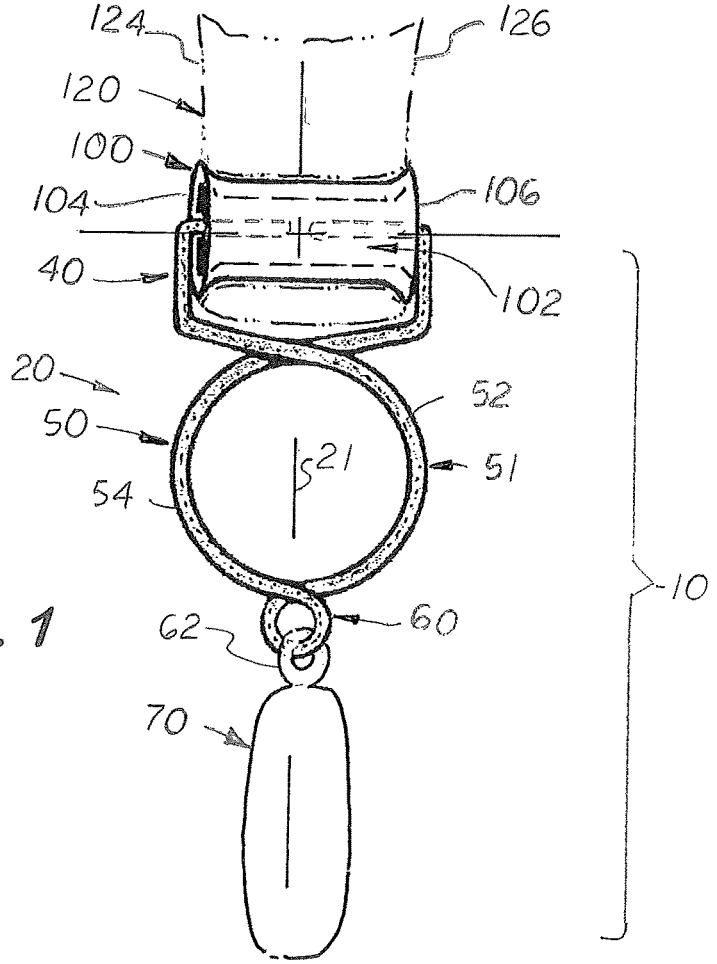
FIG. 1 is a front elevational view of a dangle jewelry that includes a decorative jewelry element attached to the compression ring formed on a relaxed, flexible finding with two posts inserted into a flesh tunnel embedded into an earlobe.

Referring to the accompanying Figs, there is disclosed dangle jewelry 10 designed to be attached to a rigid flesh tunnel 100 formed or embedded into body tissue (for illustration the body tissue is shown as an earlobe 120 but it should be understood that the flesh tunnel 100 may be formed on other types of body tissues). The flesh tunnel 100 is a cylindrical structure inserted into a gauge orifice formed in the earlobe 120. The flesh tunnel 100 includes a longitudinally aligned a center bore 102 and two end openings 104, 106.

The dangle jewelry 10 includes an adjustable finding 20 designed to selectively attached to the center bore 102 formed on the flesh tunnel 100. During use, the finding 20 acts as an intermediate structure for easily and securely hanging a decorative jewelry element 70 from the flesh tunnel 100.

Figure 11:
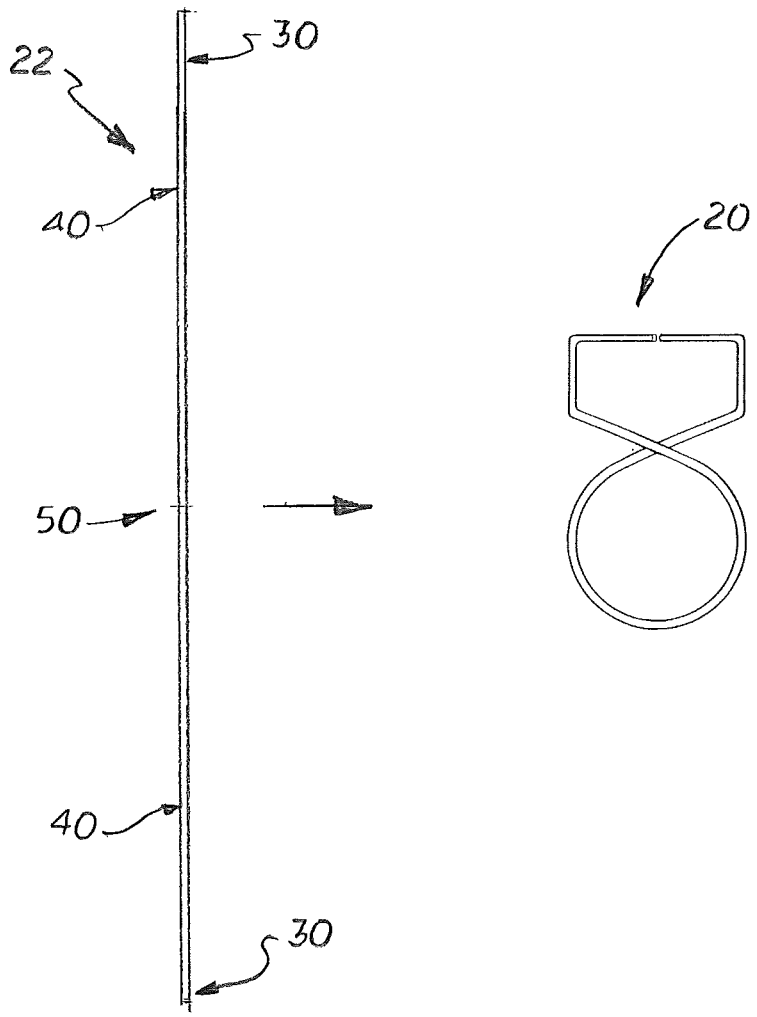
FIG. 11 is an illustration showing the relative locations on the wire that form the upper flesh tunnel engaging section, the intermediate support section, and the lower biasing section on a straight wire that is bent or configured into a finding.

The adjustable finding 20 includes a single wire 22 bent and configured into at least three interconnected sections—an upper flesh tunnel engaging section 30, an intermediate earlobe extension section 40 and a lower biasing section 50 as shown in FIG. 11.

The upper flesh tunnel engaging section 30 includes the wire's two opposing posts 32, 36 configured to be inserted into the flesh tunnel's two end openings 104, 106. After the finding 20 is formed, the posts 32, 36 are straight and longitudinally aligned to allow the ends 33, 37 to extend inward and are aligned in an end-to-end manner inside the flesh tunnel 100 as shown in FIG. 1. The lengths of the posts 32, 36 are sufficient to extend approximately 30 to 100% of the length of the center bore 102. In the embodiment shown in the Figs, a small gap may form between the ends 33, 37 of the posts 32, 36, respectively. It should be understood however that the lengths of the posts 32, 36 may be longer or shorter so long the posts 32, 36 are sufficient in length to be supported by the inside surface of the flesh tunnel 100.

Figure 7:
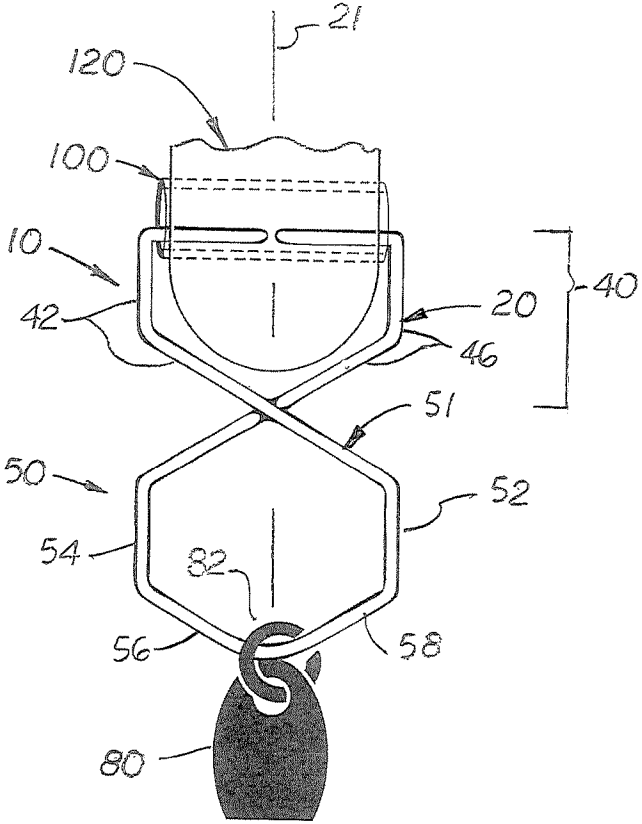
FIG. 7 is a front, sectional view of a dangle jewelry that attaches to a flesh tunnel embedded in the earlobe using a finding that includes a square-shaped intermediate section that attaches to an octagonal-shaped compression ring.
Figure 10:
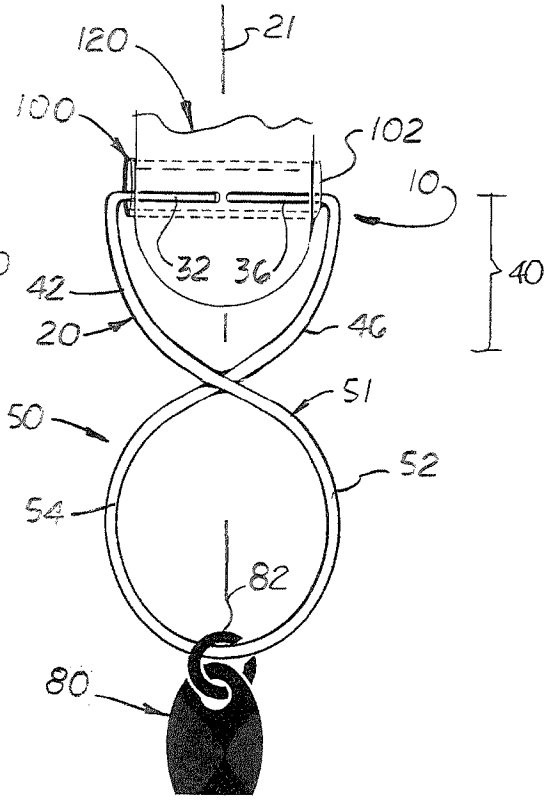
FIG. 10 is a front, sectional view of a dangle jewelry that attaches to a flesh tunnel embedded in the earlobe using a finding that includes an elongated half oval-shaped intermediate section that attaches to an oval-shaped compression ring.
Figure 9:
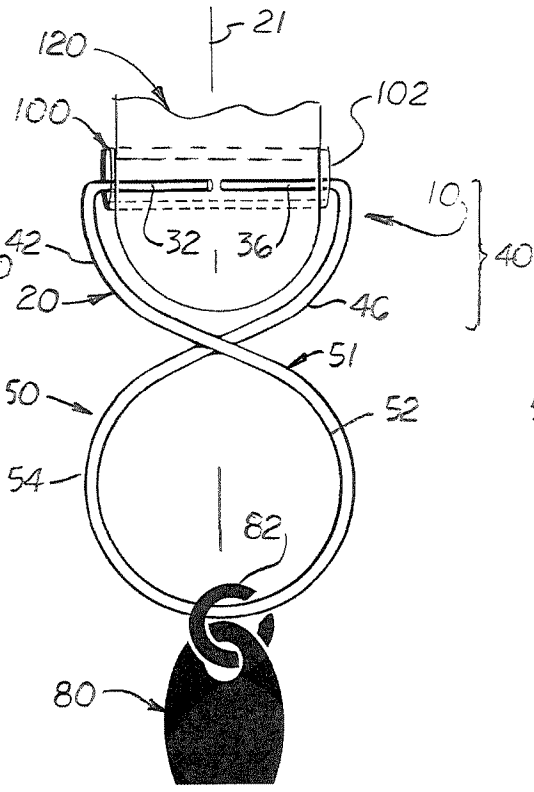
FIG. 9 is a front, sectional view of a dangle jewelry that attaches to a flesh tunnel embedded in the earlobe using a finding that includes a half oval-shaped intermediate section that attaches to a circular-shaped compression ring.
Figure 8:
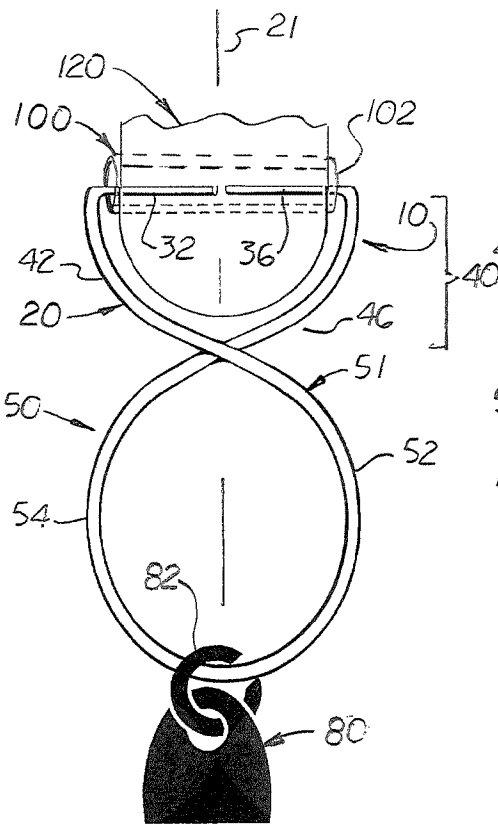
FIG. 8 is a front, sectional view of a dangle jewelry that attaches to a flesh tunnel embedded in the earlobe using a finding that includes a half oval-shaped intermediate section that attaches to an oval-shaped compression ring.

The earlobe extension section 40 includes two legs 42, 46 integrally formed to the posts 32, 36, respectively. The two legs 42, 46 extend downward on the front surface 124 and rear surface 126 of the earlobe 120, respectively. In the embodiment in FIGS. 1-7, each leg 42, 46 is a straight segment perpendicular aligned with the adjacent post 32, 34, respectively. In another embodiment, each leg 42, 46 is curved as shown in FIGS. 8-10. In all embodiments, the lower portion of the each leg 42, 46 bends inwards and downward on opposite sides of the finding's longitudinal axis 21 forming the lower biasing section 50.

Figure 2:
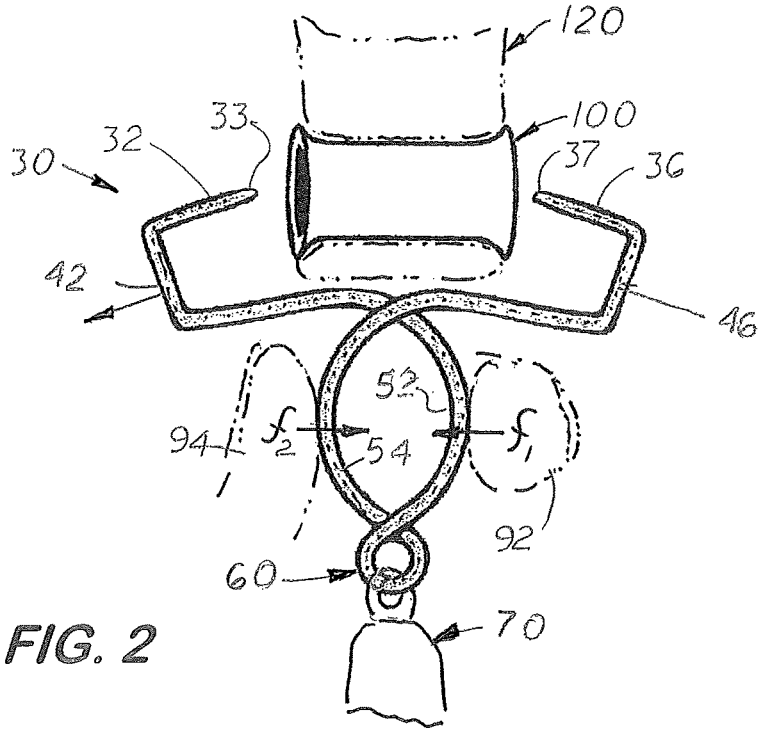
FIG. 2 is another front elevational view of the dangle jewelry shown in FIG. 1 showing the user's fingers forcing the two side elements on the compression ring inward which causes the two posts to separate and disconnect from the flesh tunnel.

The lower biasing section 50 is configured to acts as a compression spring 51 that resists light inward force applied to the opposite side elements 52, 54 on the biasing section 50. The lower biasing section 50 is a compression ring 51 with two opposite side elements 52, 54 on opposite sides of the finding's longitudinal axis 21 when attached to the flesh tunnel 100. Each side element 52, 54 is integral with a leg 42, 46, respectively formed on the opposite side of the earlobe 120. In one embodiment in FIGS. 1-6 and 8-10, the compression ring 51 is a large circular or oval loop that includes a front side element 54 integral with the leg 46 located adjacent to the rear surface of the earlobe 120 and a rear side element 52 integral with the leg 42 located adjacent to the front surface of the earlobe 120. The two side elements 52, 54 are arcs that are identical in diameter so that when an inward force is applied to the side elements 52, 54, they compress inward the same distance as shown in FIG. 2. In FIGS. 6 and 7, the compression ring 51 is shown as polygon with three straight sides elements 52, 54, and 56 or four side elements 52, 54, 56, and 58, respectively.

Figure 3:
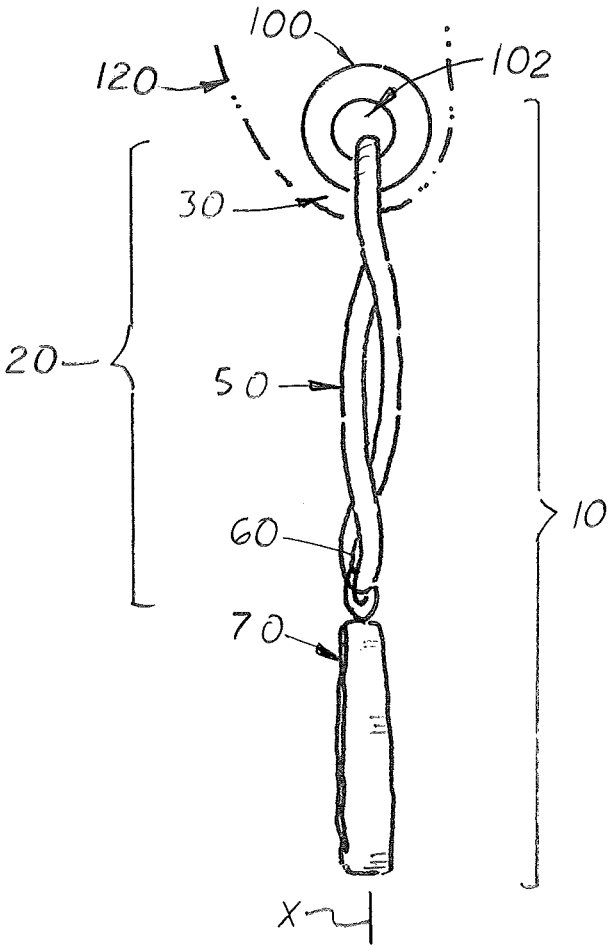
FIG. 3 is a side elevational view of dangle jewelry attached to the flesh tunnel as shown in FIG. 1.

In FIGS. 1-3, the lower portion of each arc sections curved inward towards the longitudinal axis 21 and cross at or near the longitudinal axis 21 and forming a closed lower loop 60. The closed loop 60 is aligned with the longitudinal axis 21. Attached to the closed lower loop 60 is the second small loop 62 that attaches to the decorative jewelry element 70.

As shown in FIG. 3, the upper flesh tunnel engaging section 30, the intermediate biasing loop section 40 and the lower loop 60 are aligned in a fore to aft vertical plane, denoted by the letter 'X'.

During use, the small loop 62 on the decorative element 70 attaches to the compression ring 51 on the finding 20. As shown in FIG. 2, the user places his or her two fingers 92, 94 on the outside surfaces of the two arc sections. The fingers 92, 94 are then pressed inward to apply inward opposing forces f1, f2 to the two arc sections a sufficient amount to overcome the inward biasing force exerted by the two arc segments 42, 44 on the two posts 32, 36. The ends 33, 37 of the posts 32, 36, respectively, are sufficiently forced apart to allow the two posts 32, 36 to be inserted or removed from a flesh tunnel 100.

Figure 4:
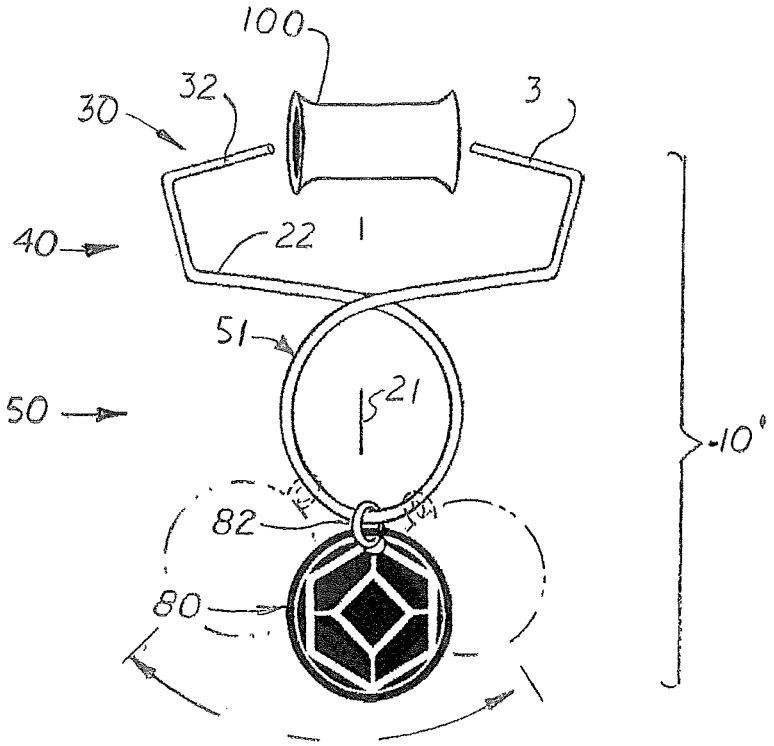
FIG. 4 is a front elevational view of another embodiment of the dangle jewelry that uses a modified finding with a compression ring and a decorative jewelry element with a small loop that selectively attaches to the compression ring.

FIG. 4 is a front elevational view of another embodiment dangle jewelry 10' that uses a modified finding 20' with an upper flesh tunnel engaging section 30, an earlobe extension section 40, and a closed, circular compression ring 51. A decorative jewelry element 80 has a small loop 82 affixed thereto. The decorative jewelry element 80 is able to slide freely over the compression ring 51.

Figure 5:
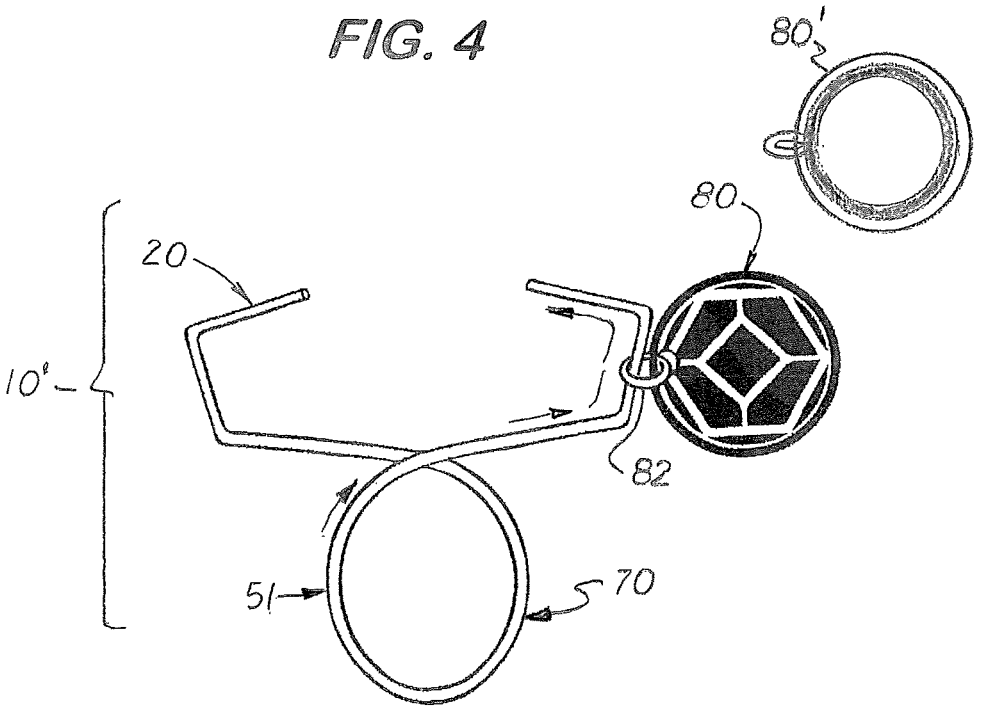
FIG. 5 is a front elevational view of the embodiment dangle jewelry, in FIG. 4 showing the decorative jewelry element with a small loop attached thereto that slides onto the compression ring and showing a replacement decorative jewelry element.
Figure 6:
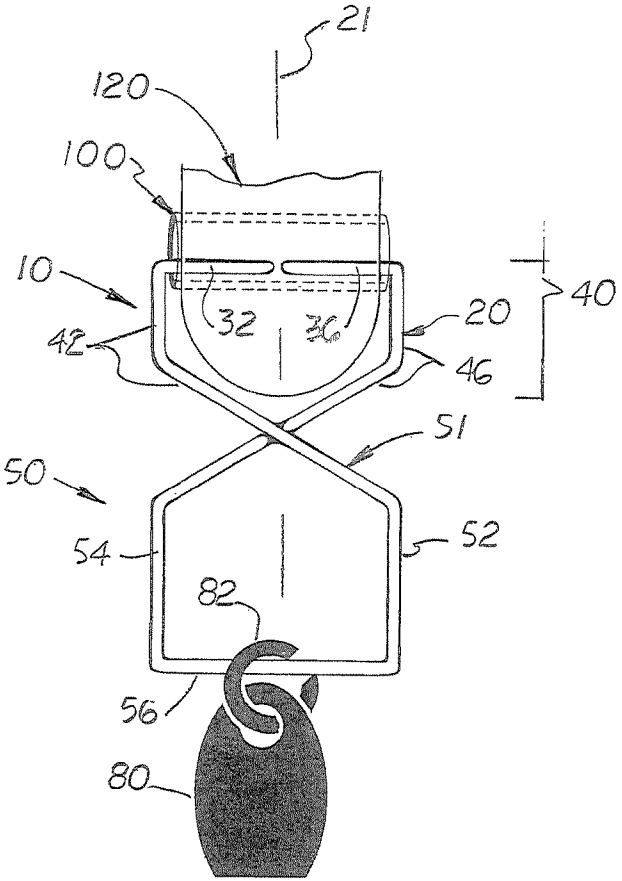
FIG. 6 is a front, sectional view of a dangle jewelry that attaches to a flesh tunnel embedded in the earlobe using a finding that includes a square-shaped intermediate section that attaches to a square-shaped compression ring.

FIG. 5 is a front elevational view of the embodiment dangle jewelry 10' shown in FIG. 4 showing the finding 20 being deformed to allow the decorative jewelry element 80 attached to separate lower loop 82 to be removed from the finding 20. A replacement decorative jewelry element 80' may used in place of the decorative jewelry element 80.

FIG. 6 is a front, sectional view of a dangle jewelry 10 that attaches to a flesh tunnel 100 using a finding 20 that includes a square-shaped earlobe extension section 40 that attaches to a square-shaped compression ring 51.

FIG. 7 is a front, sectional view of a dangle jewelry 10 that attaches to a flesh tunnel 100 using a finding 20 that includes a square-shaped earlobe extension section 40 that attaches to an octagonal-shaped compression ring 51.

FIG. 8 is a front, sectional view of a dangle jewelry 10 that attaches to a flesh tunnel 100 using a finding 20 that includes a half oval-shaped earlobe extension section 40 that attaches to an oval-shaped compression ring 51.

FIG. 9 is a front, sectional view of a dangle jewelry 10 that attaches to a flesh tunnel 100 using a finding 20 that includes a half oval-shaped earlobe extension section 40 that attaches to a circular-shaped compression ring 51.

FIG. 10 is a front, sectional view of a dangle jewelry 10 that attaches to a flesh tunnel 100 using a finding 20 that includes an elongated half oval-shaped earlobe extension section 40 that attaches to an oval-shaped compression ring 51.

In the embodiments shown herein, the diameter of the wire 22 is between 0.5 mm and 1.0 mm and is made of spring-tempered stainless steel (300 series). When the finding 20 is at rest, the legs 42, 46 are approximately 13 mm apart and each post 32, 36 is approximately 6.5 mm in length. In the embodiment shown herein, the closed loop section 50 or small loop 82 are approximately 20 to 2 mm, respectively, in diameter. The overall height or length of the finding 20 is 10 to 30 mm.

When the side elements 52, 54 are pressed inward, the ends 33, 37 of the posts 32, 36, respectively, are forced apart approximately 8 to 15 mm depending on the amount of pressure applied. Typically, the amount of force needed to squeeze the side elements 52, 54 to separate the ends 33, 37 of the posts 32, 36, respectively, is between 0.25 to 0.5 kg.

The flesh gauge 100 is approximately 3/16 to ½ inch in length, 3 to 25 mm in diameter, and the center bore 102 is at least 1 mm larger in diameter than the wire 22 used to make the finding.

The invention includes the adjustable finding 10, 10' attached to a decorative jewelry element 70, and a method for attaching the decorative jewelry element 70, 80, 80' respectively, to a flesh tunnel 100 attached to a body tissue, comprising the following steps:

a. selecting a decorative jewelry element 70, 80, 80' attached to an adjustable finding 20, 20', respectively, that includes a single wire with two opposing longitudinally aligned posts 32, 36, two opposing legs 40, 44 integral with said posts that extend over the front and rear surfaces of an earlobe with the posts inserted into the opposite ends of a flesh tunnel 100, and a compression ring 51 located below the earlobe with two side elements integral with said legs located on the opposite side of said finding's longitudinal axis when attached to an flesh tunnel 100, said decorative jewelry element 70 being attached to said compression ring, said compression ring acting as a compression ring forcing said posts into said flesh tunnel 100 and when said side elements are pressed inward, said posts move apart inside said flesh tunnel 100 allowing the finding to be detached from said flesh tunnel 100;

b. applying two inward, opposing forces on the outside surfaces of the two legs 42, 44 causing the ends of the posts 32, 36 to sufficiently separate to allow the two posts 32, 36 to be inserted into the opposite ends of a flesh tunnel 100; and c. releasing the opposing forces on the two side elements 52, 54 enabling the two posts 32, 36 to extend fully into said flesh tunnel 100.

In compliance with the statute, the invention described has been described in language more or less specific as to structural features. It should be understood, however, that the invention is not limited to the specific features shown, since the means and construction shown comprises the preferred embodiments for putting the invention into effect. The invention is therefore claimed in its forms or modifications within the legitimate and valid scope of the amended claims, appropriately interpreted under the doctrine of equivalents.

We claim:

1. A finding configured to be attached to a flesh tunnel inserted within an orifice, the orifice extending transversely in an earlobe from a front surface of the earlobe to a rear surface of the earlobe, the flesh tunnel including a center bore and two opposite open ends located adjacent to the front surface and the rear surface of the earlobe, the finding comprising:

a spring-tempered wire made of stainless steel and bent into an upper flesh tunnel engaging section, an intermediate earlobe section, and a lower compression ring; and a dangle jewelry element attached to the lower compression ring;

wherein the upper flesh tunnel engaging section includes a first post and a second post, each post configured to be inserted into one of the opposite open ends of the flesh tunnel and longitudinally aligned inside the center bore to vertically support the jewelry finding from the flesh tunnel;

wherein the intermediate earlobe section includes a first leg and a second leg, the first leg being integrally formed with the first post and the second leg being integrally formed with the second post, each leg having a straight portion perpendicularly aligned with a respective post and adjacent to the front surface or the rear surface of the earlobe when the respective post is inserted into the flesh tunnel, and each leg being bent inward such that the first leg crosses the second leg;

wherein the lower compression ring includes a first side element and second opposing side element, the first side element being integrally formed with the second leg and the second side element being integrally formed with the first leg, the first and second side elements being joined to form an enclosed structure;

wherein the lower compression ring is configured to apply an inward biasing force to each leg thereby forcing each post inward through the opposite open ends of the flesh tunnel; and wherein the lower compression ring is configured so that when sufficient inward forces are applied to the first and second side elements, the first post and the second post are forced outward from the flesh tunnel, thereby enabling the finding to be removed from the flesh tunnel.

2. The finding as recited in claim 1 wherein said dangle jewelry element is attached to a small loop that engages or integrally formed on said compression ring.

3. The finding as recited in claim 2, wherein said wire is between 0.5 mm and 1.0 mm thick.

4. The finding as recited in claim 1, wherein said compression ring is circular or oval and said side elements are curved.

5. The finding as recited in claim 1, wherein said compression ring is polygonal.

6. The finding as recited in claim 1, wherein said wire is between 0.5 mm and 1.0 mm thick.

* * * * *